US005175387A

United States Patent [19]

Greory

[11] Patent Number: 5,175,387

[45] Date of Patent: Dec. 29, 1992

[54] SEVEN STRING ELECTRIC GUITAR

[76] Inventor: Alex Greory, 10863 Fruitland Dr., Studio City, Calif. 91604

[21] Appl. No.: 636,503

[22] Filed: Dec. 31, 1990

Related U.S. Application Data

[63] Continuation-in-part of Ser. No. 436,559, Nov. 14, 1989.

[51] Int. Cl.[5] ..... G10D 1/08

[52] U.S. Cl. ..... 84/267; 84/304; 84/313; 84/314 N

[58] Field of Search ..... 84/267, 291, 293, 298, 84/299, 313, 304, 306, 312, 314

[56] References Cited

U.S. PATENT DOCUMENTS

| | | | |
|---|---|---|---|
| Re. 31,722 | 11/1984 | Steinberger | 84/327 |
| 3,302,507 | 2/1967 | Fender | 84/267 |
| 4,142,436 | 3/1979 | Chapman | 84/1.16 |
| 4,188,850 | 2/1980 | Kaman | 84/291 |
| 4,372,187 | 2/1983 | Berg | 84/1.16 |
| 4,383,466 | 5/1983 | Shibuya | 84/313 |
| 4,428,273 | 1/1984 | Favron | 84/317 |
| 4,501,185 | 2/1985 | Blucher | 84/1.15 |
| 4,539,887 | 9/1985 | Bjerkas | 84/314 R |
| 4,951,543 | 8/1990 | Cipriani | 84/298 |

*Primary Examiner*—Michael L. Gellner

*Assistant Examiner*—Eddie C. Lee

*Attorney, Agent, or Firm*—Ladas & Parry

[57] ABSTRACT

The invention is an electric guitar that has seven strings and a scale length of 25.5 inches. The highest string is a "top A" string that provides the guitarist access to higher notes than is available on a conventional guitar. This seven string guitar is constructed on a solid body and has a neck with twenty-four frets. The neck has "pronounced tapering" such that the proportionate relationship of the neck at the 24th fret and at the nut is greater in the present relationship than in the Fender Stratocaster guitar. The solid body has cut-aways on each side of the neck to permit fingering access to all the frets. The guitar has staggered headmachines so that the headmachine upon which the "top A" string is wound has a shorter post than those headmachines upon which the lower strings are wound. The guitar also has a vibrato bridge unit that is firmly connected to the solid body by two connecting screws and less than firmly attached to the solid body by two stabilizing screws. The vibrato bridge unit further has saddles mounted at maximum height to increase the sustain on the sounds generated by the guitar. A shim is placed between the neck and solid body to tilt the neck backwards to offset the raising of the strings by the raised saddles.

46 Claims, 4 Drawing Sheets

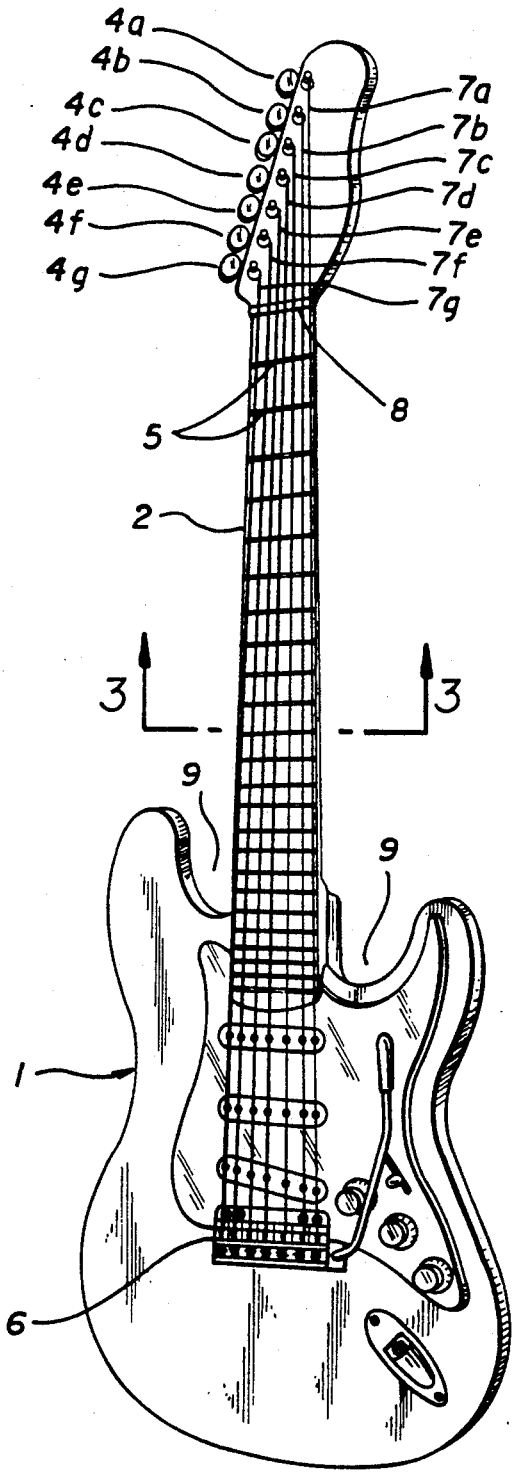
FIG. 1
FIG. 2
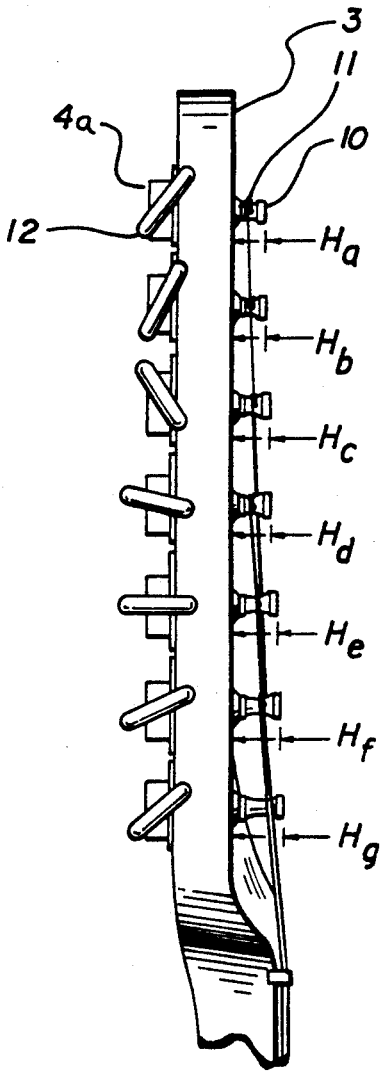
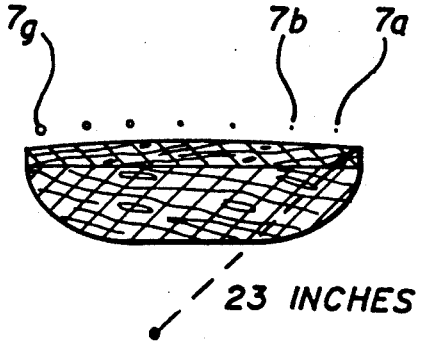
FIG. 3

FIG. 4
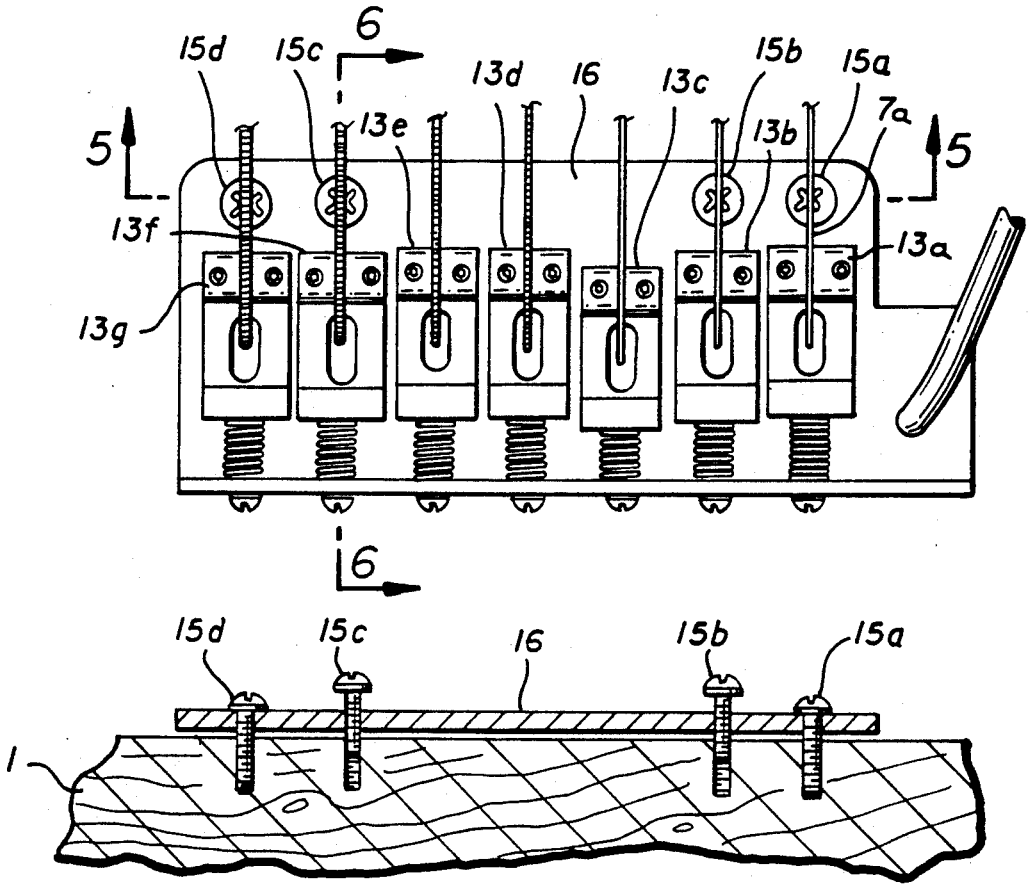
FIG. 5
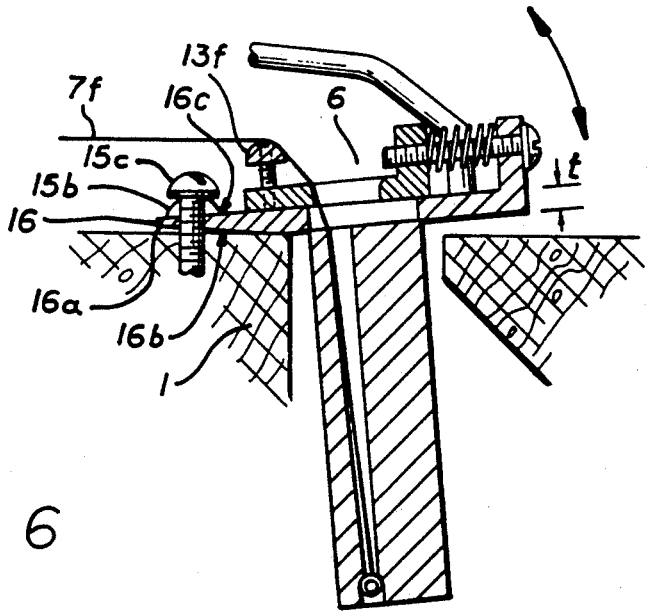
FIG. 6

SEVEN STRING ELECTRIC GUITAR

CROSS REFERENCE TO RELATED APPLICATION

This application is a continuation-in-part of U.S.S.N. No. 436,559, filed Nov. 14, 1989.

BACKGROUND OF THE INVENTION

1. Field of the Invention

This invention pertains to the field of electronic musical instruments, and more particularly to electric guitars.

2. Description of the Prior Art

An electric guitar has been well known in the art for many years. It is a standard and indispensable instrument for rock and jazz musicians. The electric guitar has also been increasingly used in the realm of classical music. However, the conventional electric guitar has a number of shortcomings that make it less than adequate in the performance of classical music.

One problem is the limited range of notes that can feasibly be played on the guitar. Prior art guitars do not have the range of, for example, a violin which is needed to perform many classical pieces. Guitar makers have attempted to extend the range of a guitar in a variety of ways. One attempt involved making a guitar with added frets on the neck of the guitar in order to reach higher notes. Another was the addition of a seventh string to the standard six-string guitar. These normally involved the addition of a lower B string so that the guitar could be used to play jazz music. Prior art attempts to add a "top A" were not workable because this added string was so thin and fragile that it broke very easily. These previous 7-string guitars were also made hollow so as to produce a "clean" sound. These earlier examples of 7-string guitars were not made with a vibrato because, being made for jazz, they had no need for a "rock tool", which the vibrato is.

A second problem was that the higher notes would be played with very little "sustain" in its sound. This was so whether the string was played very high up on a fret or, in the case of a seventh string, the string was so thin, and had so little mass that the sound became lifeless. A sustained sound is important if the guitar is to be able to play many of the classical pieces that are now played by violins. Of course, the violin has no such problem because it has a bow which, when slid against a string, provides an excellent sustained sound.

This inventor has previously attempted to devise a workable seven string guitar. The previous attempt proved to be unworkable. The following table compares the inventor's previous attempt and the present invention:

| Previous Seven String Guitar | Present Seven String Guitar |
|---|---|
| 1. Reverse headstock | 1. Non-reverse headstock |
| 2. Standard non-staggered headmachines | 2. Staggered headmachines |
| 3. No shim between neck and body | 3. Shim between neck and body |
| 4. 25 inch scale length | 4. 25½ inch scale length |
| 5. Standard tapering Stratocaster neck | 5. Pronounced tapering of neck |
| 6. Front mounted bridge | 6. Top mounted bridge |

The accumulation of the improvements made over the previous attempt results in a workable and very playable seven string instrument.

This invention constitutes an improvement on the vintage Fender Stratocaster Guitar. The description of the invention utilizes the vintage Stratocaster as a point of reference. There are two comprehensive publications on the Fender Stratocaster Guitar: "The Fender Stratocaster" by A. R. Duchossior published by Hal Leonard Publishing Corporation (1988); and "Fender Stratocaster" published by Guitar Magazine (Nov. 1987). These two publications are incorporated by reference into this application and copies of each are attached as Exhibits I and II, respectively.

SUMMARY OF THE INVENTION

The present invention provides an improved electric guitar that can be used to play classical music as well as rock music. In fact, because of the invention's range of notes and sustained sound, for the first time, a guitarist will be able to play beautiful classical pieces originally written for violin, such as the pieces written by Paganini, note for note.

A feature of the invention is that it has a newly developed seven-string vibrato bridge system. This vibrato system is extremely important both from an artistic point of view as well as from a marketing point of view. From an artistic perspective, the vibrato of this invention is essential to facilitate a "sustain" that is necessary to the playing of classical music. To this end, the invention's vibrato bridge system was designed to have a baseplate with a thickness of 0.09 inch. This is an important feature in order to be able to set saddles at maximum height with a small neck shim of 0.012 inch to obtain greatly enhanced sustain and natural ringing of the string. To obtain both flexibility and sustain, the vibrato-bridge system is top-mounted with four screws, two of which act as "stabilizers" and the other two acting as "connecting screws". From a marketing perspective, the vibrato is important in that an electric guitar will typically not sell well without it.

A second feature of the invention is a seventh string that is a "high A". This seventh string adds the additional range that is necessary to play even the most challenging pieces by Paganini, for example. Until this invention, guitars could not be made with the additional "high A" because of the propensity to string breakage and lack of sustain.

A third feature of the invention is the use of staggered headmachines. This is necessary to create a progressively greater angle of the string between the nut and the headstock towards the top A, which would otherwise have the least angle of all and therefore the least tension between the string and the nut. Without the staggered headmachines, the top A string may be floppy and vibrate. This would require the use of a string tree to urge the string down toward the headstock between the headmachine and the nut. This effectively increases the angle of the string between the nut and headstock. The increased angle of the string would result in an increase in the tension of the string causing it to be too tight and break. By appropriately lowering the headmachine, the tension of the string is increased so that it is not floppy, but not increased so much as to cause breakage, which is more apt to occur when a string tree is used. The use of a suitably chosen lowered headmachine solves the fragility problems with the high string as well as improving immensely the stability of the intonation of the instrument when using the vibrato.

A fourth feature of the invention is that it has a scale length of 25.5 inches and 24 frets instead of the more standard 21 or 22 frets. The longer scale allows fingering above the 12th fret with a comfort not available with a shorter scale. Because of a double cutaway construction, the total 24 frets are now usable.

A fifth feature of the invention is that it has a solid body so that it can be overdriven to simulate a rock or sustained violin-like sound.

A sixth feature of the invention is that the neck has "pronounced tapering". "Pronounced tapering" refers to the aspect of the invention wherein the proportionate relationship of the neck width at the 24th fret and at the nut is greater in the present invention than in the Fender Stratocaster guitar. "Pronounced tapering" is important for comfort and playability.

BRIEF DESCRIPTION OF THE DRAWINGS

In describing the invention, reference will be made to the accompanying drawings wherein:

FIG. 1 is a top plane view of the guitar.

FIG. 2 is a side view of the headstock of the guitar and the headmachines mounted thereon.

FIG. 3 is a cross-sectional view of the neck and strings of the guitar as indicated in FIG. 1 as 3—3.

FIG. 4 is a top view of the vibrato bridge unit.

FIG. 5 is a cross-sectional view of the vibrato bridge unit as indicated in FIG. 4 as 5—5.

FIG. 6 is a cross-sectional view of the vibrato bridge unit as indicated in FIG. 4 as 6—6.

DETAILED DESCRIPTION

Figure 7:
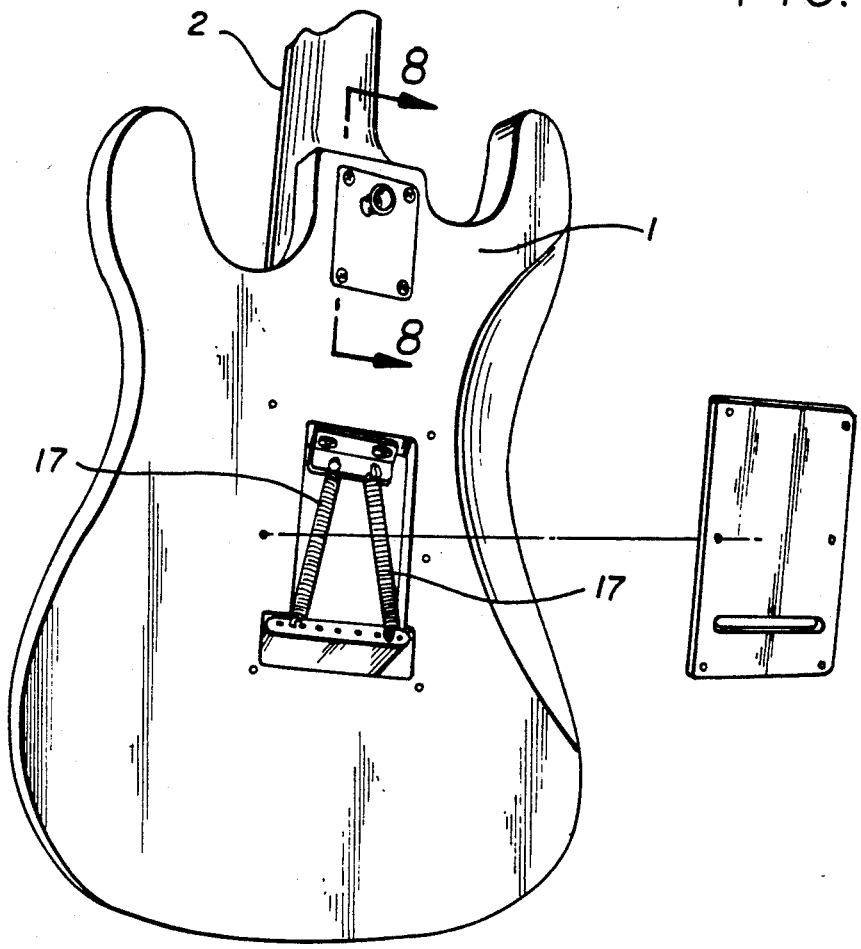
FIG. 7 is an exploded bottom view of the solid body of the guitar with a view of the springs connecting the vibrato bridge unit to the solid body.

Referring now to the drawings, there is illustrated in FIG. 1 a top plane view of the seven-string guitar. The guitar has a solid ashwood body 1 and a neck 2 connected to the solid body 1. One type of wood that may be used to make the body is ashwood. Another type of wood the body may be constructed from is maplewood. The neck has a headstock portion 3 upon which is mounted seven staggered headmachines 4*a*–4*g*. The neck 2 has twenty-four frets 5 and has a scale length, the distance from a nut to the bridge saddles, of 25.5 inches. Topmounted on the solid body is a vibrato bridge unit 6. The guitar has seven strings 7*a*–7*g*, an end of each string 7 being attached to a headmachine and the other end of the strings 7 being connected to the vibrato bridge unit 6. Each string 7 compressively rests on a nut 8 situated between the frets 5 and the headmachines 4*a*–4*g*. Although the thicknesses of the strings 7 can vary, in the preferred embodiment, standard strings would be used for the lowest six strings 7*b*–7*g* with an added highest string 7*a*. Starting with the lowest string, the standard set comprises: a wound low E string with 0.042 inch diameter, a wound low A string of 0.032 inch diameter, a wound D string of 0.024 inch diameter, a G string of 0.016 inch diameter, a B string of 0.0115 inch diameter and a top E string of 0.009 inch diameter. The seventh string 7*a* is a top A string of 0.006 inch diameter. The use of a standard set of strings is important for commercial success since 70% of the guitar strings used today are of the above description for strings 7*b*–7*g*. Other set gauges can be used but then, of course, the seventh string 7*a* would necessarily be of a different diameter. The solid body 1 has double cutaways 9 near the neck 2 of the guitar so that the guitarist will have access to the frets 5 located on the neck nearest to where the neck 2 is joined to the solid body 1.

FIG. 2 provides a more detailed view of the staggered headmachines 4*a*–4*g*. Each headmachine provides the mechanism for tuning a string 7 of the guitar. The headmachine has a post 10 around which a string is wrapped, a base portion 11 that is located adjacent to the headstock 3, and a tuning lever 12 which, when turned, rotates the post 10. The posts are of "staggered" or "varying" heights and are noted in FIG. 2 as Ha–Hg. In the preferred embodiment, the posts 10 are of the following heights: The posts associated with the top A and top E strings are each $\frac{7}{8}$th of an inch high; the posts associated with the B and G strings are each 15/16th of an inch high; and the posts associated with the D, low A and low E strings are each 1 inch high. Standard Kluson type vintage Stratocaster headmachines used on Stratocasters have 1 inch high posts. When installed onto the headstock 3 of the guitar and held in place by base plates 11, the posts rise from the surface of the headstock by the following distances: The posts associated with the top A and top E strings are 5/16 of an inch; the posts associated with the B and G strings are each 6/16 of an inch, and the posts associated with the D, low A and low E strings are 7/16 of an inch. For optimum performance, the B string 7*c* should be wrapped around its associated post $1\frac{3}{4}$ rotations, the top E string 7*b* should be wrapped around its associated post 3 rotations and the top A string 7*a* should be wrapped around its associated post 5 rotations.

The staggered headmachines 4*a*–4*g* are an important feature because unless the headmachines associated with the higher tone and thinner strings are lowered with respect to the headstock 3, those strings 7 would not be pulled tightly enough against the nut 8 and would tend to flop and vibrate against the nut 8 during playing. A possible remedy would be to utilize a string tree but this would result in string-breakage problems for the thin top A string.

FIG. 3 illustrates a cross-sectional view of the neck 2. The neck 2 is specially designed for comfort and a visually balanced look, both of which are essential from a marketing point of view. Because the neck 2 is necessarily wider to accommodate the additional seventh string 7*a*, the neck 2 must be modified so that the guitar can comfortably be held and manipulated by the guitarist. To this end, the general radius of the neck 2 has been increased to 23 inches as indicated in FIG. 3.

Figure 9:
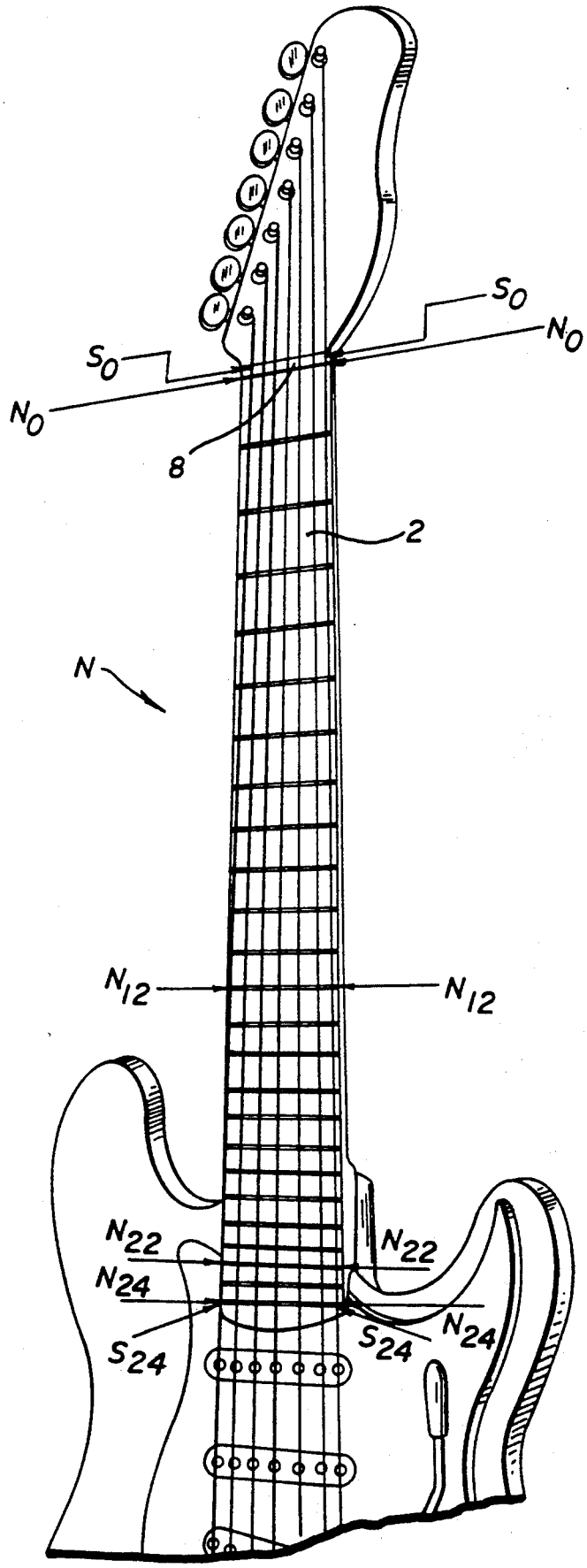
FIG. 9 is a plan view of the guitar's neck depicting the preferred neck width specifications.

FIG. 9 should be referred to as an illustration of the width dimensions of the neck N. The subscripts refer to the associated fret number. In the preferred embodiment, the width of the neck 2 at the nut 8 ($N_0$—$N_0$) is $1\frac{7}{8}$ inch (approximately 1.875 inch or 47.6 mm); the width of the neck 2 at the 12th fret ($Nu_{12}-N_{12}$) is approximately 2 11/32 inch (about 2.36 inch or 59.9 mm). The width of the neck at the 22nd fret ($N_{22}$—$N_{22}$) is approximately 2 18/32 inch (2.56 inch or 65 mm); and the width of the neck 2 at the 24th fret ($N_{24}-N_{24}$) is approximately 2 21/32 inch (about 2.67 inch or over 67 mm). The thickness of the neck 2 between the nut 8 and the first fret is 0.845 inch; the thickness of the neck at the 12th fret is 0.902 inch; and the thickness of the neck 2 at the neckjoint between the 17th and 18th frets is 0.82 inch. The distance between the central axes of the top A string and low E string at the nut is substantially 1 20/32 inch. The distance between the central axes of the top A string and the low E string at the bridge is approximately 2 20/32 inch. Consequently, the distance between the central axes of the top A string and low E string at the 24th fret is 2 12/32 inch.

The proportionate relationship of the neck width at the 24th fret and at the nut 8 is greater in the present invention than in the Fender Stratocaster or other comparable guitars. This feature is known as "pronounced tapering" and is important for comfort and playability. The practical effect of "pronounced tapering" is that the guitarist is provided with a neck that "feels" like that of a six string guitar. The neck, as measured at the nut, is wider to accommodate the additional seventh string. However, it is not proportionately wider, i.e., it is not an additional 1/6 as wide. Rather, the increase in width is less than 1/6 as wide as that of the Stratocaster. The following illustrates this point. The standard stratocaster has a neck width at the nut of about 1.685 inch. Increased by 1/6, the width of the neck at the nut for a seven string guitar should be 1.97 inch. This compares with a neck width at this nut for the present invention of 1.875 inch. This gives the guitarist the feel of a six string guitar. However, the neck flares outward towards the lower part of the neck because the spacing between the strings at the vibrato saddles 13 (FIG. 4) is the same as that in the large strat vintage saddles. Because the trend of modern day guitar making is to use saddles that are narrower than the vintage Stratocaster saddles, this feature of "pronounced tapering" runs counter to the direction of the art. By going counter to the trend, a surprising result is reached wherein superior ease and playability is attained by the feature of "pronounced tapering". It should be noted that the dimension specified above for the width of various portions of the neck are preferred but may vary. An important feature is the relative greater proportion between the lower portion of the neck to the upper portion of the neck when comparing the present invention to the Fender Stratocaster and other comparable guitars. The following exemplifies this feature. Since the widths of the neck of the Vintage Stratocaster are 1.68 inch and 2.225 inch at the nut and last fret respectively, this ratio is 1.317. The "last fret" is the fret on the neck that is remotest from the nut. For the present invention, the widths of the neck at the nut and last fret are 1.875 inch and 2.67 inch, respectively. This results in a ratio of 1.424.

FIGS. 4–6 illustrate the vibrato bridge unit 6. The vibrato bridge unit 6, preferably has a vintage FENDER bridge/vibrato baseplate thickness t of 0.09 inch. The vibrato bridge unit 6 also has seven saddles 13*a*–13*g* upon each of which is mounted one of the seven strings. The thickness of the vibrato bridge unit 6 is essential to setting the saddles 13*a*–13*g* at maximum height. The bottom E, top E and top A strings are mounted on saddles 13*g*, 13*b* and 13*a*, which are attached by 5/16 of an inch screws 13.1 while the low A, D, G and B strings are mounted on saddles 13*f*–13*c* that are attached by 3/8 inch screws 13.1. Because the saddles 13*a*–13*g* are set at maximum height, a small neck shim 14 of 0.012 inches is inserted between the neck 2 and the solid body 1 so that the neck 2 is tilted backward permitting the string to be located in closer proximity to the frets on the neck 2. If the saddles 13*a*–13*g* are not set at maximum height, a different tension is created in the bridge area. By setting the saddles 13*a*–13*g* at maximum height, the sustained and natural ringing of the strings 7*a*–7*g* is greatly enhanced by the increased tension exerted on the string by the raised saddles.

The vibrato bridge unit 6 is mounted onto the solid body 1 by four screws 15*a*–15*d*. Two of the screws are connecting screws 15*a*, 15*d* that are located on extreme ends of a top mounting portion 16 of the vibrato bridge unit 6. These connecting screws 15*a*, 15*d* firmly connect the vibrato bridge unit 6 to the solid body 1. Two stabilizing screws 15*b*, 15*c* are each located inside of each of the connecting screws on the top mounting portion 16. Unlike the connecting screws 15*a*, 15*d*, the stabilizing screws 15*b*, 15*c* do not firmly adhere the vibrato bridge unit 6 to the solid body 1. Instead, the screws are rotated less than firmly into the vibrato bridge unit 6 with the result that the bottom flat portion of the screw head confronting the top mounting portion 16 of the vibrato bridge unit 6 is spaced from the vibrato bridge unit 6 by approximately 0.05 inch. By mounting the vibrato bridge unit 6 to the solid body 1 in this way, the sustained and natural rich ringing of the string, as well as the flexibility, is enhanced. If only two connecting screws 15*a*, 15*d* are used, when the vibrato bridge unit 6 is utilized, the connecting screws would necessarily be larger, requiring a front mounted bridge as used in the standard Floyde Rose bridge. But with a front-mounted vibrato bridge unit, much of the vibrato bridge unit 6 would tend to float above the solid body 1. This type of construction tends to maximize flexibility but, on the other hand, much of the natural resonance of the strings is not transferred to the solid body 1. On the other hand, if 4, 5, or 6 screws are firmly embedded into the solid body 1 of the guitar, resonance would be increased but the vibrato bridge unit 6 would lack flexibility. An ideal medium is therefore reached by utilizing two connecting screws 15*a*, 15*d* and two stabilizing screws 15*b*, 15*c*. This construction permits the bridge 6 to touch the body 1 and therefore communicate resonances and sustain otherwise lost. The stabilizing screws assure that the holes in the body will not enlarge because of the strain put on otherwise only two small screws. As best viewed in FIG. 6, the construction of the vibrato bridge unit is conventional, like that of the Vintage Stratocaster except that it is wider to accommodate the additional saddle. The top mounting portion 16 is inclined on its side facing the body 1 from edge 16*a* until first point 16*b*. First point 16*b* is located below second point 16*c*, the point where each screw 15*a* and 15*d* contacts the top mounting portion as the vibrato unit is actuated. First point 16*b* is slightly closer to the axis of screws 15*a* and 15*d* than second point 16*c*. By enhancing the flexibility of the vibrato bridge unit 6 with this construction, jerky movement of the unit, and therefore the friction exerted on the strings, is minimized. This, in turn, minimizes breakage and tuning stability problems.

Figure 8:
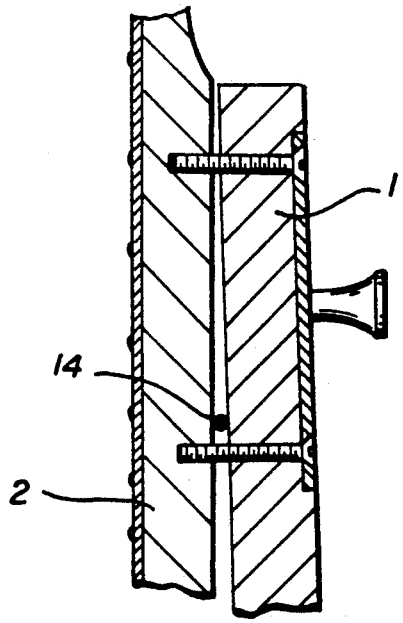
FIG. 8 is a cross-sectional view of the guitar at the area where the neck is connected to the solid body of the guitar with a shim placed therebetween as indicated in FIG. 7 as 8—8.

The vibrato bridge unit 6 has two springs 17 that connect the vibrato bridge unit 6 to the solid body 1. This is best viewed in FIG. 7. FIG. 8 illustrates the insertion of a shim 14 between the neck 2 and the solid body 1 so that the neck 2 is tilted backwards. The use of the shim 14 offsets the setting of the saddles 13*a*–13*g* at maximum height and permits the various strings to engage closely with the nut 8.

It should be borne in mind that the drawings are not rendered in actual scale so that certain features of the invention can be brought out and depicted.

The drawings and the foregoing description are not intended to represent the only form of the invention in regard to the details of its construction and manner of operation. In fact, it will be evident to one skilled in the art that modifications and variations made be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

The invention is claimed as follow:

1. A guitar comprising:

seven strings tuned to different notes, a highest tuned of said seven strings being tuned to a selected note higher than a top E and a lowest tuned of said seven strings being tuned to a lowest note;

a body;

a bridge unit, said seven strings being connected to said bridge unit;

means for mounting said bridge unit to said body; and seven headmachines, each headmachine having a post, each headmachine being associated with one of said seven strings and said posts having heights that are staggered so that the post of the headmachine associated with said selected note is shorter than the post of the headmachine associated with said string tuned to said lowest note.

2. A guitar as claimed in claim 1 further comprising a neck attached to said body, said neck having mounted thereon twenty-four frets.

3. A guitar as claimed in claim 2 wherein said neck has a scale length of 25.5 inches.

4. A guitar as claimed in claim 2 wherein said mounting means comprises said bridge unit having a top mounting portion and two connecting screws that are located on extreme ends of said top mounting portion and firmly connecting said top mounting portion to said body, and two stabilizing screws respectively located inside of each of said connecting screws, said stabilizing screws acting as stabilizers and are rotated less than firmly into said bridge unit and said body.

5. A guitar as claimed in claim 2 wherein said mounting means comprises said bridge unit having a top mounting portion and two connecting screws that are located on extreme ends of said top mounting portion and firmly connecting said top mounting portion to said body, and two stabilizing screws respectively located inside of each of said connecting screws, said stabilizing screws having a flat surface confronting said top mounting portion, said flat surface spaced from said top mounting portion by approximately 0.05 inch.

6. A guitar as claimed in claim 2 wherein said seven strings comprise a top A string of 0.006 inch diameter, a top E string o 0.009 inch diameter, a B string of 0.0115 inch diameter, a G string of 0.016 inch diameter and wound D string of 0.024 inch diameter, a wound A string of 0.032 inch diameter and a low E string of 0.042 inch diameter.

7. A guitar as claimed in claim 6 wherein said posts associated with said top A and said top E strings are each $\frac{7}{8}$ of an inch high; said posts associated with said B and G strings are each 15/16 of an inch high; and said posts associated with said D, A and low E strings are each one inch high.

8. A guitar as claimed in claim 7 wherein said neck has a headstock, said posts associated with said top A and said top E strings extend from a surface of the headstock by 5/16 inch; said posts associated with said B and G strings extend from a surface of the headstock by 6/16 inch; and said posts associated with said D, A and low E strings extend from a surface of the headstock by 7/16 inch.

9. A guitar as claimed in claim 6 wherein said bridge unit has saddles for setting each string, said saddles for said low E string, top E string and top A string each connected to said bridge unit by 5/16 inch screws and said saddles for said A string, D string, G string and B string each connected to said bridge unit by $\frac{3}{8}$ inch screws, each said saddle set at maximum height on their associated screws.

10. A guitar as claimed in claim 1 wherein said bridge unit has a base plate, said base plate being substantially 0.09 inch thick.

11. A guitar as claimed in claim 2 further comprising a shim placed between said neck and said body so that said neck is tilted away from said body at an end nearest to said headmachines.

12. A guitar as claimed in claim 11 wherein said shim is of 0.012 inch in thickness.

13. A guitar as claimed in claim 1 wherein said body is made of ashwood.

14. A guitar as claimed in claim 1 wherein said bridge unit has two springs connecting said bridge unit to said body, said springs urging said bridge unit to an equilibrium position during use of said bridge unit.

15. A guitar as claimed in claim 2 wherein said body has double cutaways adjacent to said neck so that a user will have access to fingering said frets located closest to said bridge unit.

16. A guitar comprising:

seven strings, the strings comprising a top A string, a top E string, a B string, a G string, a D string, a low A string, and a low E string;

a solid body;

a vibrato bridge unit, said vibrato bridge unit having saddles upon which said strings each can be mounted, said saddles adjustably fastened to said vibrato bridge unit by associate screws, each said saddle set at maximum height on their associated screws;

means for mounting said vibrator bridge unit to said solid body;

a neck attached to said solid body;

a shim placed between said neck and said solid body so that said neck is tilted away from said solid body at an end of said solid body furthest from said vibrato bridge unit; and seven headmachines, each headmachine having a post, each headmachine being associated with one of said seven strings and said posts having lengths that are staggered so that the post of the headmachine associated with said top A string is shorter than the post of the headmachine associated with said low E string.

17. A guitar as claimed in claim 16 wherein said screws associated with said saddles mounting said low E, top E and top A strings are 5/16 inch in height and said screws associated with said saddles mounting said low A, D G and B strings are 154 inch in height.

18. A guitar as claimed in claim 16 wherein said neck has a scale length of 25.5 inches.

19. A guitar as claimed in claim 16 wherein said neck has mounted thereon 24 frets.

20. A guitar as claimed in claim 16 wherein said mounting means comprises said vibrato bridge unit having a top mounting portion and two connecting screws that are located on extreme ends of said top mounting portion and firmly connect said top mounting portion and firmly connect said top mounting portion to said solid body, and two stabilizing screws respectively located inside of each of said connecting screws, said stabilizing screws having a flat surface confronting said top mounting portion, said flat surface spaced from said top mounting portion by approximately 0.05 inch.

21. A guitar as claimed in claim 16 wherein said posts associated with said top A and said top E strings are each $\frac{7}{8}$- of an inch high; said posts associated with said B and G strings are each 15/16 of an inch high; and said posts associated with said D, low A and low E strings are each one inch high.

22. A guitar as claimed in claim 16 herein said neck has a headstock, said posts associated with said top A and said top E strings extend from a surface of the headstock by 5/16 inch: and posts associated with said B and G strings extend from a surface of the headstock by 6/16 inch; and said posts associated with said D, low A and low E strings extend from a surface of the headstock by 7/16 inch.

23. A guitar as claimed in claim 16 wherein said B string is wrapped around its associated post 1182 rotations; said top E string is wrapped around its associated post 3 rotations; said top A string is wrapped around its associated post 5 rotations.

24. A guitar as claimed in claim 16 wherein said shim is of 0.012 inch in thickness.

25. A guitar as claimed in claim 16 wherein said solid body is made of ashwood.

26. A guitar as claimed in claim 16 wherein said vibrato bridge unit has two springs connecting said vibrato bridge unit to said solid body, said springs urging said vibrator bridge unit to an equilibrium position during use of said vibrato bridge unit.

27. A guitar as claimed in claim 16 wherein said solid body has double cutaways adjacent to said neck so that a user will have access to fingering said frets located closest to said vibrato bridge unit.

28. A guitar comprising:

seven strings, the strings comprising a top A string, a top E string, a B string, a G string, a D string, a low A string, and a low E string;

a solid body;

a vibrato bridge unit, said vibrato bridge unit having saddles upon which said strings each can be mounted, said saddles for each string set at maximum height on associated screws;

means for mounting said vibrato bridge unit to said solid body;

a neck attached to said solid body;

a shim placed between said neck and said solid body so that said neck is tilted away form said solid body at an end of said solid body furthest from said vibrato bridge unit; and seven headmachines, each headmachine having a post, each headmachine being associated with one of said seven strings and said posts having lengths that are staggered so that the post of the headmachine associated with said top A string is shorter than the post of the headmachine associated with said low E string.

29. A guitar as claimed in claim 28 wherein said screws associated with said saddles mounting said low E, top E and to A strings are 5/16 inch in height and said screws associated with said saddles mounting said low A, D, G and B strings are $\frac{3}{8}$ inch in height.

30. A guitar as claimed in claim 28 wherein said mounting means comprises said vibrato bridge unit having a top mounting portion and two connecting screws that are located on extreme ends of said top mounting portion and firmly connect said top mounting portion and firmly connect said top mounting portion to said solid body, and two stabilizing screws respectively located inside of each of said connecting screws, said stabilizing screws having a flat surface confronting said top mounting portion, said flat surface spaced from said top mounting portion by approximately 0.05 inch.

31. A guitar as claimed in claim 28 wherein said top A string is of 0.006 inch diameter, construction said top E string is of 0.009 inch diameter construction, said B string is of 0.012 inch diameter construction, said G string is of 0.016 inch diameter construction, said D string is of 0.024 inch diameter wound construction said low A string is of 0.032 inch diameter wound construction and said low E string is of 0.042 inch diameter wound construction.

32. A guitar as claimed in claim 28 wherein said posts associated with said top A and said top E strings are each $\frac{7}{8}$ of an inch in length; said posts associated with said B and G strings are each 15/16 of an inch in length; and said posts associated with said D, low A and low E strings are each one inch in length.

33. A guitar as claimed in claim 32 wherein said neck has a headstock, said posts associated with said top A and said top E strings extend from a surface of the headstock by 5/16 inch; said posts associated with said B and G strings extend from a surface of the headstock by 6/16 inch; and said posts associated with said D, low A and low E strings extend from a surface of the headstock by 7/16 inch.

34. A guitar as claimed in claim 28 wherein said solid body has double cutaways adjacent to said neck so that a user will have access to fingering said frets located closest to said vibrato bridge unit.

35. A guitar comprising:

seven strings, the strings comprising a top A string, a top E string, a B string, a G string, a D string, a low A string, and a low E string;

a neck, said neck having mounted thereon 24 frets;

a solid body, said neck attached to said solid body, said solid body having double cut-aways at an area adjacent to said neck to permit fingering access to said frets;

a vibrato bridge unit, said vibrato bridge unit having saddles upon which said strings each can be mounted, said saddles for said low E, top E and top A strings are set at maximum height on 5/16 inch screws, said saddles for said low A, D, G and B strings are set at maximum height on $\frac{3}{8}$ inch screws, said vibrato bridge unit having a top mounting portion and two connecting screws that are located on extreme ends of said top mounting portion and firmly connect said top mounting portion to said solid body, and two stabilizing screws respectively located inside of each of said connecting screws, said stabilizing screws having a flat surface confronting said top mounting portion, said flat surface spaced from said top mounting portion by approximately 0.05 inch.

a shim placed between said neck and said solid body so that said neck is tilted away form said solid body at an end of said solid body furthest from said vibrato bridge unit; and seven headmachines, each headmachine having a post, said posts associated with said top A and said top E strings are each $\frac{7}{8}$ of an inch high; said posts associated with said B and G strings are each 15/16 of an inch high; and said posts associated with said D, low A and low E strings are each one inch high.

36. A guitar as claimed in claim 1 wherein said solid body is made of maple wood.

37. A guitar as claimed in claim 16 wherein said solid body is made of maple wood.

38. A guitar comprising:

seven strings, the strings comprising a top A string, a top E string, a B string, a G string, a D string, a low A string, and a low E string;

a solid body;

a vibrato bridge unit, said vibrato bridge unit having saddles upon which said strings each can be mounted, said saddles for each string set at maximum height on associated screws;

means for mounting said vibrato bridge unit to said solid body;

a neck attached to said solid body;

a shim placed between said neck and said solid body so that said neck is tilted away from said solid body at an end of said solid body furthest from said vibrato bridge unit;

seven headmachines, each headmachine having a post, said posts associated with said top a and said top E strings are each $\frac{7}{8}$ of an inch high; said posts associated with said B and G strings are each 15/16 of an inch high; and said posts associated with said D, low A and low E strings are each one inch high; and wherein said posts associated with said top A and said top E string extend from a surface of said headstock by 15/16 inch; said posts associated with said B and G strings extend from a surface of the headstock by 6/16 of an inch; and said posts associated with said D, low A and low E strings extend from a surface of the headstock by 7/16 inch.

39. A guitar comprising:

seven strings tuned to different notes, a highest tuned of said seven strings being tuned to a selected note higher than a top E and a lowest tuned of said seven strings being tuned to a lowest note;

a body;

a neck attached to said body, said neck having a headstock;

seven headmachines disposed on said headstock, each headmachine having a post upon which one of said seven strings is mounted and associated, a post associated with the string tuned to a selected note higher than a top E extending from a surface of said headstock a shorter distance than a post of the headmachine associated with said lowest note of said seven strings.

40. A guitar as claimed in claim 39 wherein said neck has mounted thereon twenty-four frets.

41. A guitar as claimed in claim 40 wherein said neck has a scale length of 25.5 inches.

42. A guitar as claimed in claim 41 further comprising a vibrato bridge unit, said seven strings being connected to said vibrato bridge unit, and means for mounting said vibrato bridge unit to said body.

43. A guitar as claimed in claim 39 wherein said seven strings comprise a top A string, a to E string, a B string, a G string, a D string, a low A string and a low E string.

44. A guitar as claimed in claim 43 wherein said posts associated with said top A and said top E string extend from a surface of said headstock by 5/16 inch; said posts associated with said B and G strings extend from a surface of the headstock by 6/16 of an inch; and said posts associated with said D, low A and low E strings extend from a surface of the headstock by 7/16 inch.

45. A guitar as claimed in claim 16 wherein said post associated with said top A string is shorter than the post of the headmachine associated with said B string.

46. A guitar as claimed in claim 29 wherein said post associated with said top A string is shorter than the post of the headmachine associated with said B string.

* * * * *

UNITED STATES PATENT AND TRADEMARK OFFICE

CERTIFICATE OF CORRECTION

PATENT NO. : 5,175,387

DATED : December 29, 1992

INVENTOR(S) : Alex Gregory

It is certified that error appears in the above-identified patent and that said Letters Patent is hereby corrected as shown below:

| | |
|---|---|
| Column 4, line 62 | Please change "$(Nu_{12}-N_{12})$" to --$(N_{12}-N_{12})$--. |
| Column 5, line 3 | Please change "0.82" to -- .982 --. |
| Column 8, last line | Please change "154" to -- 3/8 --. |
| Column 9, line 31 | Please change "1182" to -- 1 3/4 --. |

Signed and Sealed this

Twenty-fifth Day of January, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,175,387

DATED : December 29, 1992

INVENTOR(S) : Alex Gregory

It is certified that error appears in the above-indentified patent and that said Letters Patent is hereby corrected as shown below:

On title page, item [76] change the spelling of the inventor's last name from "Greory" to -- Gregory --.

Item [19] "Greory" should read --Gregory--.

Signed and Sealed this

Sixteenth Day of August, 1994

*Attest:*

*Attesting Officer*

BRUCE LEHMAN

*Commissioner of Patents and Trademarks*